US007136024B2

(12) United States Patent
Yuanzhu et al.

(10) Patent No.: US 7,136,024 B2
(45) Date of Patent: Nov. 14, 2006

(54) SLOT ANTENNA HAVING HIGH GAIN IN ZENITH DIRECTION

(75) Inventors: Dou Yuanzhu, Fukushima-ken (JP); Yoshio Saito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 2 days.

(21) Appl. No.: 11/030,491

(22) Filed: Jan. 5, 2005

(65) Prior Publication Data

US 2005/0168389 A1 Aug. 4, 2005

(30) Foreign Application Priority Data

Jan. 5, 2004 (JP) ..... 2004-000544
Jun. 7, 2004 (JP) ..... 2004-168751

(51) Int. Cl.
*H01Q 13/10* (2006.01)
*H01Q 1/38* (2006.01)

(52) U.S. Cl. ..... 343/767; 343/700 MS

(58) Field of Classification Search ..... 343/700 MS, 343/702, 767, 746
See application file for complete search history.

(56) References Cited

U.S. PATENT DOCUMENTS 2,555,443 A * 6/1951 Harvey ..... 342/385
4,916,457 A * 4/1990 Foy et al. ..... 343/770
4,922,263 A * 5/1990 Dubost et al. ..... 343/797
5,581,266 A * 12/1996 Peng et al. ..... 343/770
5,914,693 A 6/1999 Takei et al.
6,452,552 B1 * 9/2002 Ishitobi et al. ..... 343/700 MS
6,774,853 B1 * 8/2004 Wong et al. ..... 343/700 MS
2002/0050954 A1 * 5/2002 Jeong-Kun et al. ..... 343/770
2003/0043084 A1 * 3/2003 Egashira ..... 343/767
2004/0066345 A1 * 4/2004 Schadler ..... 343/767
2006/0033670 A1 * 2/2006 Schadler ..... 343/767

FOREIGN PATENT DOCUMENTS

JP 01170202 7/1989
JP 04207207 7/1992
JP 11-186836 7/1999
JP 2003-218629 7/2003

* cited by examiner

*Primary Examiner*—Don Wong
*Assistant Examiner*—Hung Tran Vy
(74) *Attorney, Agent, or Firm*—Chadbourne & Parke LLP

(57) ABSTRACT

The present invention provides a slot antenna in which the radiation toward the zenith direction is not obstructed although it is arranged on an upper side of a ground conducting plate.

The antenna device 11 operates as the slot antenna by providing a slot 14 in an upper plate portion 13 of a shield case 12. The shield case 12 is provided on a ground conducting plate 20. The slot 14 is composed of a first aperture 15 extending in a straight line, a second aperture 16 communicating with one end of the longitudinal direction of the first aperture 15, and a third aperture 17 communicating with the other end of the longitudinal direction of the aperture 15. The apertures 16 and 17 have the same triangular shapes which are point-symmetrical to the center of the aperture 15. When the power is fed by a feeding pin 18 to excite the slot 14, the directions of the electric fields generated at the apertures 16 and 17 are inclined to the direction of the electric field generated at the aperture 15 and the electric fields of the apertures 16 and 17 cancel the electric field of the aperture 15.

6 Claims, 4 Drawing Sheets

SLOT ANTENNA HAVING HIGH GAIN IN ZENITH DIRECTION

BACKGROUND OF THE INVENTION

1. Field of the Invention

The present invention relates to a slot antenna arranged at an upper side of a ground conducting plate, and particularly to a slot antenna having a high gain in the zenith direction.

2. Description of the Related Art

FIG. 6 is a plan view showing a conventional general slot antenna. A slot 2 extending in a straight line is provided in a conducting member 1 made of a metal plate or a metal foil, and a feeding pin 3 for supplying a high frequency power to the conducting member 1 is provided perpendicular to a predetermined feeding point. The feeding pin 3 is connected to an amplifying circuit or a filter circuit (not shown), and the power is fed by the feeding pin 3 to excite the slot 2. Also, since the electric field traversing the slot 2 in the width direction is generated upon the excitation, the horizontally polarized wave is radiated toward the just upper side (the zenith direction) or is obliquely radiated toward the upper side, and thus the radio wave signal transmitted in these directions can be received. In addition, as a feeding method, there is a structure which the feeding point is arranged at the vicinity of both ends of the slot 2 in the width direction (for example, see Japanese Unexamined Patent Application Publication No. 2003-218629 (page 2, FIG. 5)) or a structure which a feed line perpendicular to the slot 2 is provided in the lower side of the conducting member 1.

Since such a slot antenna can be cheaply manufactured and can be easily miniaturized, it is suitable to an antenna device for a vehicle. In other words, when the conducting member 1 having the slot 2 is provided on the top surface of the dielectric substrate and an electronic circuit such as an amplifying circuit is mounted on the bottom surface of the dielectric substrate, a cheap small-sized antenna device is obtained. In addition, if an upper plate portion of a shield case accommodating the circuit substrate is used as the conducting member 1 and the slot 2 is provided on the upper plate portion, a very cheap antenna device can be obtained.

However, in the case in which the slot antenna is applied to the antenna device for a vehicle, there are many cases that the dielectric substrate or the shield case is provided on a relatively large ground conducting plate. However, as shown in FIG. 7, if the ground conducting plate 4 extends toward the outside of the conducting member 1 having the slot 2, the reverse electric field Eb is induced between the conducting member 1 and the ground conducting plate 4 upon the excitation of the slot 2. Thereby, the original electric field Ea traversing the slot 2 in the width direction is apt to be canceled by the reverse electric field Eb. At the result, the radiation toward the inclined upper side due to the reverse electric field Eb becomes strong, but the radiation toward the zenith direction becomes weak. Therefore, for example, in the case in which it is applied to the antenna device for ETO (Electronic Toll Collection), it is difficult to obtain a desired sensitivity.

SUMMARY OF THE INVENTION

The present invention is made in consideration of the problems of the prior art, and it is an object of the present invention to provide a slot antenna in which the radiation toward a zenith direction is not obstructed although it is arranged on the upper side of a ground conducting plate.

In order to solve the above-mentioned problems, in a slot antenna according to the present invention, a slot composed of a first aperture extending in a straight line, a second aperture communicating with one end of a longitudinal direction of the first aperture, and a third aperture communicating with the other end of the longitudinal direction of the first aperture are provided in a conducting member which is arranged on an upper side of a ground conducting plate at a predetermined interval, the second aperture and the third aperture are in a point-symmetrical location relationship with respect to a center of the first aperture, the second and third apertures have a width larger than that of the first aperture, directions of electric fields generated at the second and third apertures are inclined to a direction of an electric field generated at the first aperture upon feeding the power, and the component perpendicular to the longitudinal direction among the electric fields of the second and third apertures cancels the electric field of the first aperture.

Since the second and third apertures having a wide width are formed in the both ends of the slot in the slot antenna having the above-mentioned structure, the radiation from the second and third apertures becomes stronger than the radiation from the first aperture having a narrow width. In addition, since the directions of the electric fields E2 and E3 generated at the second and third apertures are inclined to the direction of the electric field E1 generated at the first aperture and the electric field E1 is cancelled by the components E2Q and E3Q perpendicular to the longitudinal direction of the first aperture in the electric fields E2 and E3, the components E2P and E3P parallel to the longitudinal direction in the electric fields E2 and E3 are mainly propagated into space. In addition, since the electric fields E2 and E3 generated at the both ends of the slot can not induce the reverse electric field although the ground conducting plate extends at the outside of the conductor member having the slot, the horizontally polarized wave is strongly radiated toward the zenith direction by the electric field components E2P and E3P. As a result, it is possible to obtain the slot antenna having the high gain in the zenith direction.

In the slot antenna, it is preferable that one side forming the external shape of the second aperture and one side forming the external shape of the third aperture be parallel to each other and be inclined to the longitudinal direction of the first aperture. In this case, it is preferable that the external shapes of the second and third apertures be triangular of which the width becomes gradually wide from a portion connected to the first aperture to a portion away from the first aperture. Thereby, the structure in which the directions of the electric fields E2 and E3 are inclined to the electric field E1 and the radiation from the second and third apertures becomes stronger than the radiation from the first aperture can be easily realized.

In the slot antenna, a pair of the slots is provided in the conducting member such that the centers are matched to each other, the first apertures of each slot are perpendicular to each other, and the antenna operates as a circularly polarized wave antenna by exciting each slot with a phase difference of about 90 degrees.

In the slot antenna, the conducting member is an upper plate portion of a case manufactured by a metal plate provided on the ground conducting plate. Therefore, since the upper plate portion such as a shield case accommodating a circuit substrate can be used as the slot antenna, the cheap small-sized antenna device having the high gain in the zenith direction can be obtained.

In this case, a reinforcing portion having a rib shape is formed on the upper plate portion of the case forming the conductor member so as to surround two sides forming the external shape of at least one aperture in the second and third apertures. Therefore, since the strength for the impact or the vibration applied to the antenna can increase, the performance deterioration due to the impact or the vibration from the outside can be prevented.

In the slot antenna according to the present invention, since the radiation from the second and third apertures formed at the both ends of the slot is stronger than the radiation from the first aperture having a narrow aperture and the directions of the electric fields generated at the second and third apertures are inclined to the direction of the electric field generated at the first aperture, the reverse electric field can not be induced although the ground conducting plate extends at the outside of the conducting member having the slot, and the horizontally polarized wave can be strongly radiated to the zenith direction by the component parallel to the longitudinal direction of the first aperture in the electric fields generated at the second and third apertures. Thereby, the cheap small-sized slot antenna having the high gain in the zenith direction can be obtained.

DESCRIPTION OF THE PREFERRED EMBODIMENT

Hereinafter, embodiments of the present invention will be described with reference to the accompanying drawings.

Figure 1:
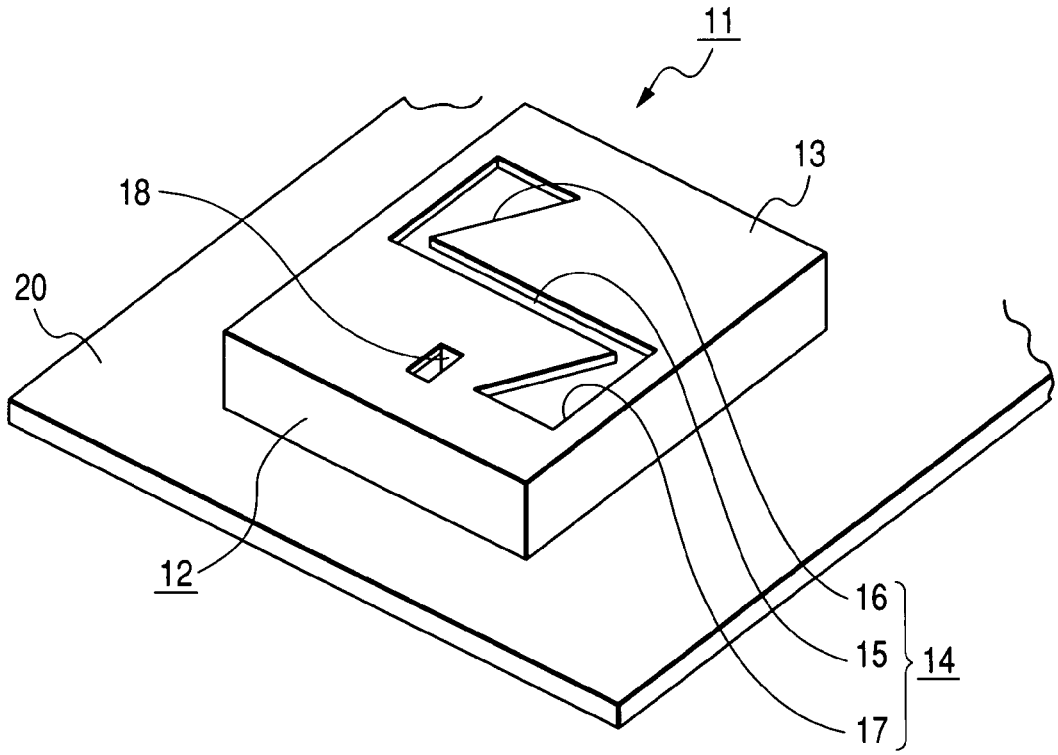
FIG. 1 is a perspective view of an antenna device according to a first embodiment of the present invention.
Figure 2:
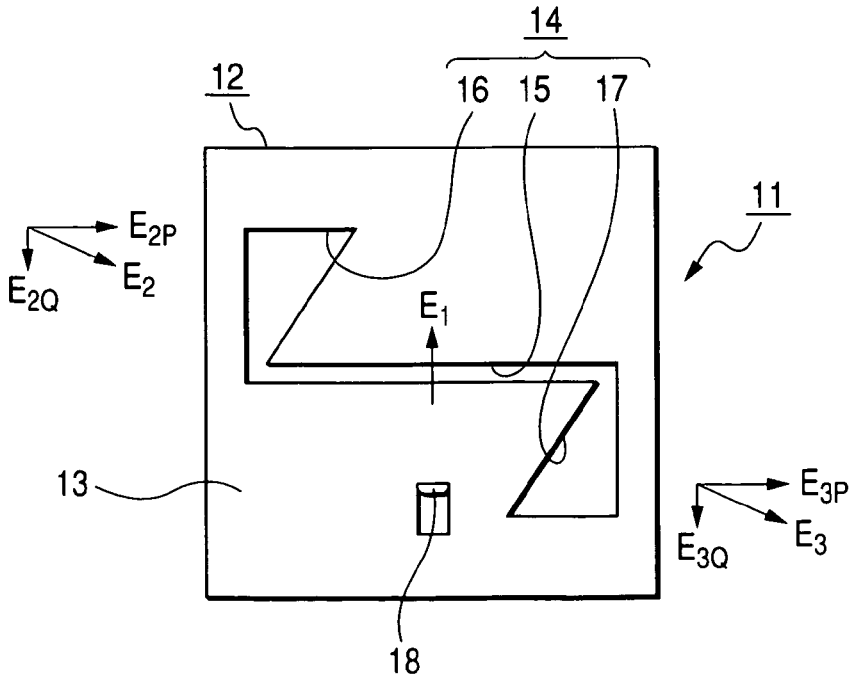
FIG. 2 is a plan view of the antenna device.
Figure 3:
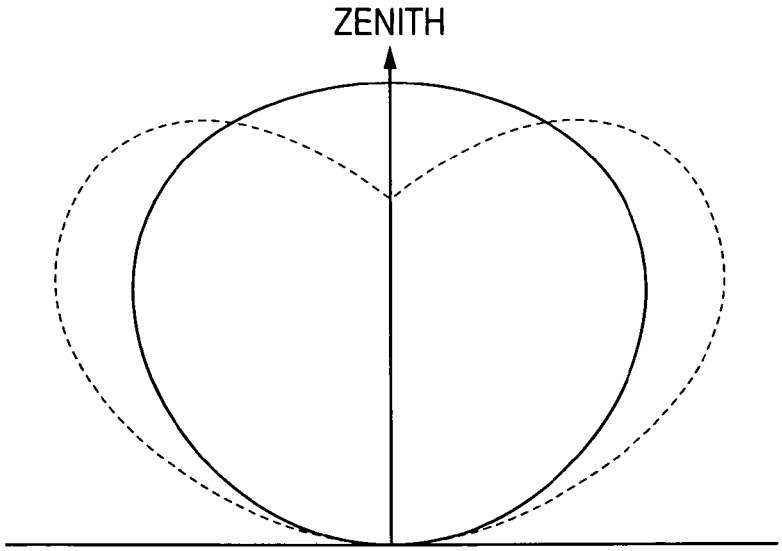
FIG. 3 is a characteristic diagram showing the radiation pattern of the antenna device.

FIG. 1 is a perspective view of an antenna device according to a first embodiment of the present invention, FIG. 2 is a plan view of the antenna device, and FIG. 3 is a characteristic diagram showing the radiation pattern of the antenna device.

The antenna device 11 shown in FIGS. 1 and 2 operates as a slot antenna. A slot 14 having approximately a Z shape is provided in an upper plate portion 13 of a shield case 12 made of a metal plate and the shield case 12 is arranged on a ground conducting plate 20. The slot 14 is composed of a first aperture 15 extending in a straight line shape, a second aperture 16 communicating with one end of a longitudinal direction of the first aperture 15, and a third aperture 17 communicating with the other end of the longitudinal direction of the first aperture 15. The first aperture 15 is a band-shaped aperture having a narrow width, and the second aperture 16 and the third aperture 17 have wide widths and are formed in the location and the shape which is point-symmetrical with respect to the center of the first aperture 15. Specifically, the second aperture 16 and the third aperture 17 are formed in the same triangular shape with the width that becomes gradually wider from the portion connected to the first aperture 15 to the portion away from the first aperture 15. Among three sides of this triangle, one side is inclined to a longitudinal direction of the first aperture 15, another side is perpendicular to the longitudinal direction thereof, and the other side is parallel to the longitudinal direction thereof. In addition, a part of the upper plate portion 13 is formed of an erecting piece functioning as a feeding pin 18 at a predetermined location which is the feeding point. The power is fed by this feeding pin 18 to excite the slot 14.

As shown in the vector of FIG. 2, when the power is fed to excite the slot 14, the electric field E1 is generated at the first aperture 15 and the electric fields E2 and E3 are generated at the second and third apertures 16 and 17, respectively. Here, the electric fields E2 and E3 are stronger than the electric field E1 and are inclined to the electric field E1, and the electric field E1 is substantially cancelled by the components E2Q and E3Q perpendicular to the longitudinal direction of the first aperture 15 in the electric fields E2 and E3.

In addition, in the shield case 12, a circuit substrate (not shown) in which an amplifying circuit or a filter circuit is arranged is accommodated and the front end (the lower end) of the feeding pin 18 is soldered on the circuit substrate.

In the antenna device 11 having the above-mentioned structure, since the second and third apertures 16 and 17 each having a wide width are formed at the both ends of the slot 14, the radiation from the second and third apertures 16 and 17 becomes stronger than the radiation from the first aperture 15 having the narrow width. Moreover, since the directions of the electric fields E2, E3 generated at the second and third apertures 16 and 17 are inclined to the direction of the electric field E1 generated at the first aperture 15 and the electric field E1 is cancelled by the components E2Q and E3Q perpendicular to the longitudinal direction of the first aperture 15 in the electric fields E2 and E3, the components E2P and E3P parallel to the longitudinal direction of the first aperture 15 in the electric fields E2 and E3 are mainly propagated into space. In addition, since the electric fields E2 and E3 generated at the both ends of the slot 14 can not induce the reverse electric field although the ground conducting plate 20 extends at the outside of the upper plate portion 13, the horizontally polarized wave is strongly radiated toward the zenith direction by the electric field components E2P and E3P.

A curve shown by a solid line in FIG. 3 is the radiation pattern of the antenna device 11 and it is apprehend that the radiation toward the zenith direction is strong. To the contrary, assuming that the second and third apertures 16 and 17 are not formed and the slot 14 has a general straight-line shape, the radiation pattern is a curve shown by a dotted line in FIG. 3 and the radiation toward the zenith direction becomes weak.

Moreover, since the antenna device 11 uses the upper plate portion 13 of the shield case 12 as the slot antenna, the manufacture thereof is easy. Also, since the lower plate portion of the shield case 12 functions as the reflecting plate of the slot antenna, the radiation efficiency toward the upper side can increase. Accordingly, it is possible to achieve the cheap small-sized antenna device 11 with a high gain in the zenith direction.

Figure 4:
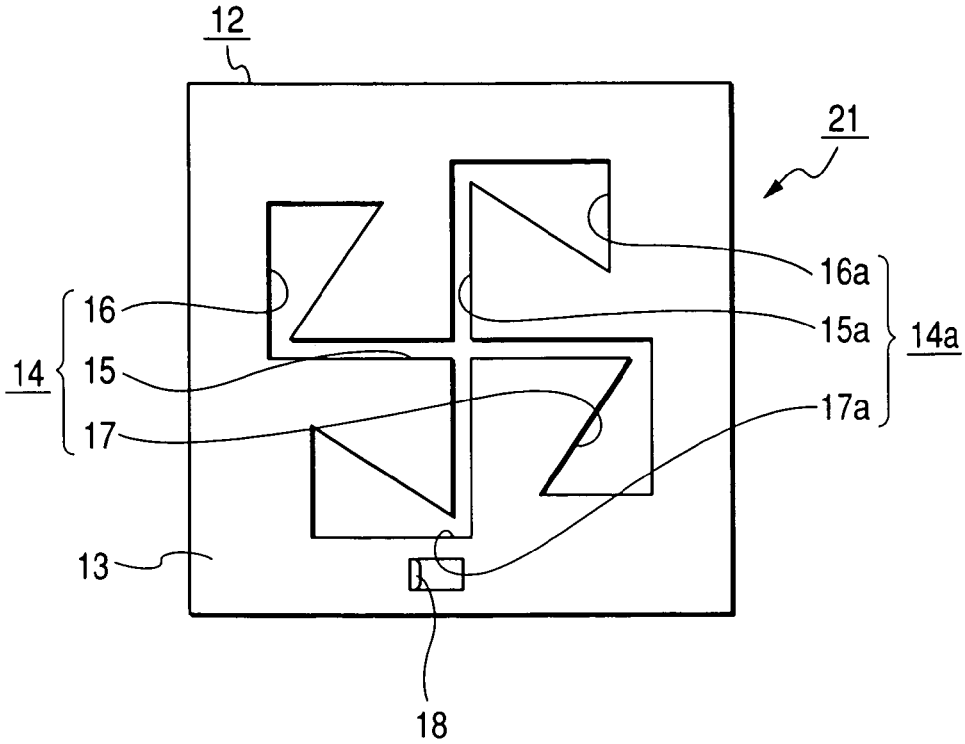
FIG. 4 is a plan view of an antenna device according to a second embodiment of the present invention.

FIG. 4 is a plan view of an antenna device according to a second embodiment of the present invention, wherein portions corresponding to those of FIG. 2 are attached with the same reference numerals. In the antenna device 21 shown in FIG. 4, a pair of slots 14 and 14*a* is provided in the upper plate portion 13 of the shield case 12 such that the centers thereof are matched with each other. The antenna device functions as a circularly polarized wave antenna.

Here, the slot 14*a* is a aperture having approximately a Z shape similar to that of the slot 14, and is composed of a first aperture 15*a* corresponding to the first aperture 15, a second aperture 16*a* corresponding to the second aperture 16, and a third aperture 17*a* corresponding to the third aperture 17. In addition, the first apertures 15 and 15*a* of the slots 14 and 14*a* are perpendicular to each other, and the slots 14 and 14*a* are excited with a phase difference of about 90 degrees.

Specifically, the location of the feeding pin 18 formed by cutting and erecting a portion of the upper plate portion 13 is set such that the phase difference of about 90 degrees is generated at each of the slots 14 and 14*a*. In other words, the feeding pin 18 is formed at an appropriate location away from the slot 14 but close to the slot 14*a* and generates the phase difference of about 90 degrees by the difference of the distances between the feeding pin 18 and the corresponding location of each of the slots 14 and 14*a*.

Thereby, the antenna device 21 can operates as the circularly polarized wave antenna having a high gain in the zenith direction. In addition, since the antenna can be cheaply manufactured and can be easily miniaturized, it is suitable for the ETC antenna for a vehicle having a high gain in the zenith direction.

Figure 5:
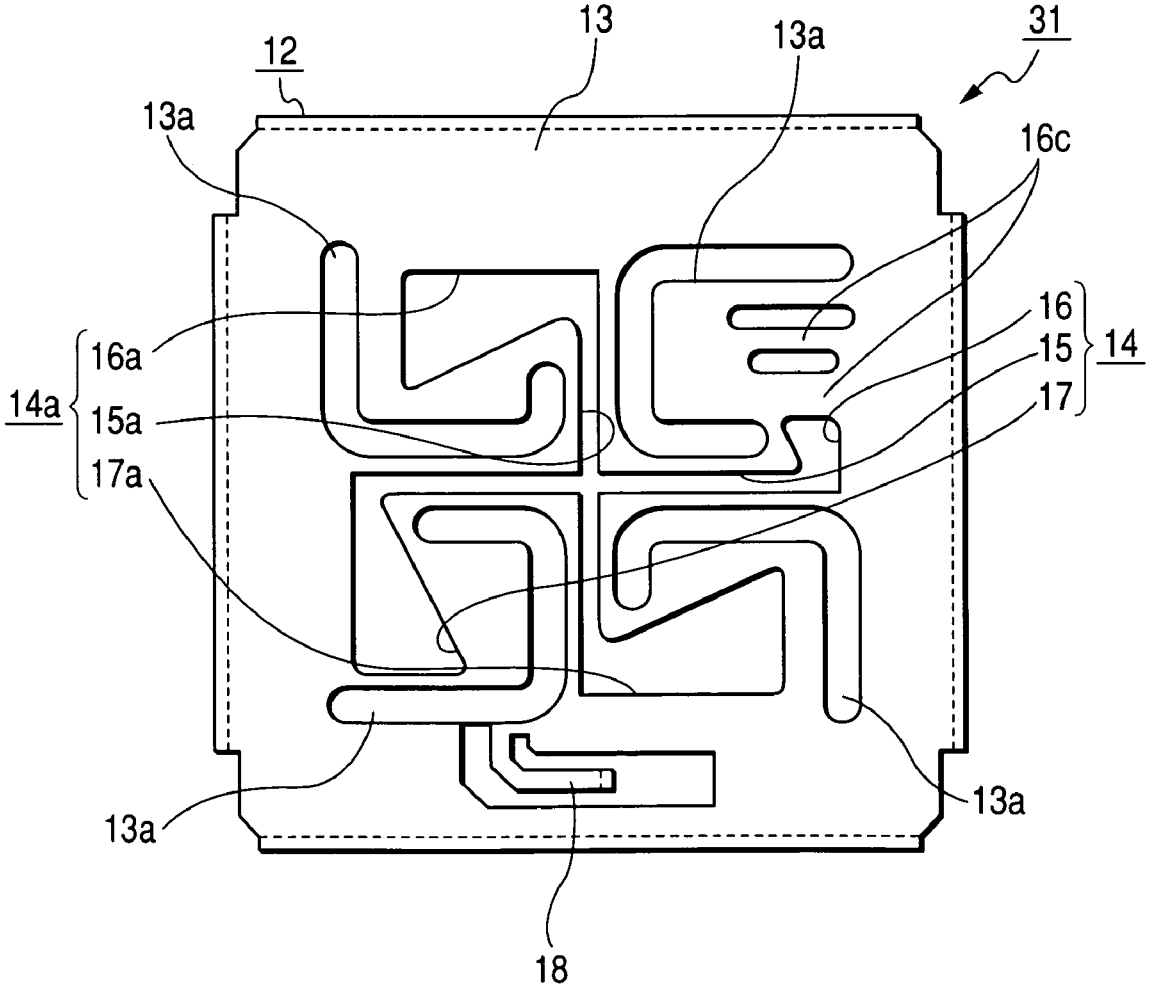
FIG. 5 is a plan view of an antenna device according to a third embodiment of the present invention.
Figure 6:
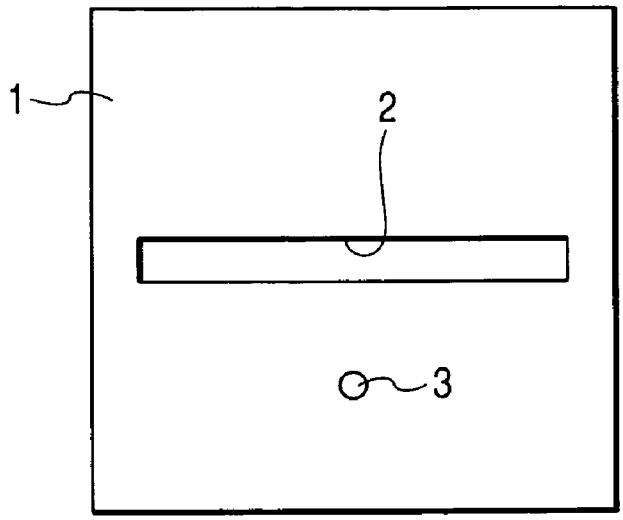
FIG. 6 PRIOR ART
FIG. 6 is a plan view showing a conventional general slot antenna.
Figure 7:
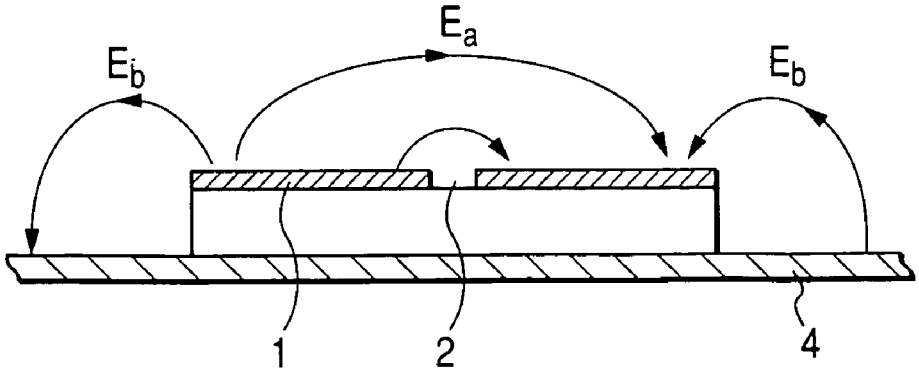
FIG. 7 PRIOR ART
FIG. 7 is a diagram illustrating a problem of the conventional slot antenna.

FIG. 5 is a plan view of an antenna device according to a third embodiment of the present invention, wherein the portions corresponding to those of FIG. 4 are attached with the same reference numerals. In an antenna device 31 shown in FIG. 5, similarly to the second embodiment, a pair of slots 14 and 14*a* each having a different distance from the feeding pin 18 is provided in the upper plate portion 13 of the shield case 12 such that the centers thereof are matched to each other and functions as the circularly polarized wave antenna. In other words, the slot 14*a* formed in an appropriate location close to the feeding pin 18 is the aperture having approximately a Z shape similar to that of the slot 14 away from the feeding pin 18 and is composed of a first aperture 15*a* corresponding to the first aperture 15, a second aperture 16*a* corresponding to the second aperture 16 and a third aperture 17*a* corresponding to the third aperture 17. Also, the first apertures 15 and 15*a* of the slots 14 and 14*a* are perpendicular to each other, and the slots 14 and 14*a* are excited with a phase difference of about 90 degrees.

Moreover, in the antenna device 31 shown in FIG. 5, reinforcing portions 13*a* each having a rib shape are formed in plural locations of the upper plate portion 13 of the shield case 12 and the reinforcing portion 13*a* are formed so as to surround two sides of the second apertures 16 and 16*a* and the third apertures 17 and 17*a* each having the triangular shape in the both slots 14 and 14*a*. Each reinforcing portion 13*a* is obtained by expanding the upper plate portion 13 toward the inside or the outside thereof and can be simultaneously formed when a pair of the slots 14 and 14*a* or the feeding pin 18 is pressed and punched in the upper plate portion 13. If the reinforcing portion 13*a* is formed in the upper plate portion 13 of the shield case 12, the reinforcing portions 13*a* having a rib shape exist at the periphery of the relatively largely notched second apertures 16 and 16*a* and third apertures 17 and 17*a* and the mechanical strength for the impact or vibration applied to the antenna is increased by the reinforcing portion 13*a*. Thereby, the performance deterioration due to the impact or vibration from the outside can be prevented.

Furthermore, in the antenna device 31 shown in FIG. 5, a connecting portion 16*c* is formed in, for example, the second aperture 16 of the slot 14 among the second apertures 16 and 16*a* and the third apertures 17 and 17*a* each having a triangular shape in the both slots 14 and 14*a*, and thus the axial ratio of the circularly polarized wave antenna can be adjusted. In other words, the second aperture 16 is formed in the similar triangular shape that the connecting portion 16*c* is provided between a plurality of the apertures of which the width becomes gradually wide and the substantial size of the second aperture 16 can be changed by cutting the connecting portion 16*c*.

What is claimed is:

1. A slot antenna, comprising a slot including a first aperture extending generally in a straight line, a second aperture communicating with one end of a longitudinal direction of the first aperture, and a third aperture communicating with another end of the longitudinal direction of the first aperture, said first, second and third apertures being disposed in a conducting member of a ground conducting plate at a predetermined interval, the second aperture communicating only with an end of one of the long sides of the first aperture and the third aperture communicating with only an end of the other long side of the first aperture, the second aperture and the third aperture being in a point-symmetrical location relationship with respect to a center of the first aperture, the second and third apertures having a width larger than that of the first aperture, directions of electric fields generated at the second and third apertures being inclined to a direction of an electric field generated at the first aperture upon feeding power, and a component perpendicular to the longitudinal direction among the electric fields of the second and third apertures canceling the electric field of the first aperture.

2. The slot antenna according to claim 1, wherein a side of the second aperture and a side of the third aperture are parallel to each other and are inclined to the longitudinal direction of the first aperture.

3. The slot antenna according to claim 2, wherein the second and third apertures are generally triangular in configuration, each of said second and third apertures having a width that becomes wider from a portion adjacent to the first aperture to a portion away from the first aperture.

4. The slot antenna according to claim 1, comprising a second slot disposed in the conducting member the second slot having first, second and third apertures, the first and second slots having centers that are matched to each other, the first apertures of each slot being perpendicular to each other, wherein the antenna is operable as a circularly polarized wave antenna by exciting each slot with a phase difference of about 90 degrees.

5. The slot antenna according to claim 1, wherein the conducting member is an upper plate portion of a shield case provided on the ground conducting plate.

6. The slot antenna according to claim 5, comprising a reinforcing portion having a generally rib shape disposed on the upper plate portion of the case so as to substantially surround two sides forming an external shape of at least one aperture in the second and third apertures.

* * * * *